United States Patent [19]

Nagashima

[11] 4,262,350

[45] Apr. 14, 1981

[54] SOLID STATE ELECTRONIC TIMEPIECE WITH LAMP

[75] Inventor: Shinichi Nagashima, Suwa, Japan

[73] Assignee: Kabushiki Kaisha Suwa Seikosha, Tokyo, Japan

[21] Appl. No.: 963,055

[22] Filed: Nov. 22, 1978

[30] Foreign Application Priority Data

Nov. 22, 1977 [JP] Japan ..... 52-140453

[51] Int. Cl.[3] ..... G04B 19/30; G04C 19/00

[52] U.S. Cl. ..... 368/67; 368/82; 368/227

[58] Field of Search ..... 58/23 R, 23 BD, 38 R, 58/50 R; 368/67, 82–84, 85, 155–157, 227, 239–242

[56] References Cited

U.S. PATENT DOCUMENTS

| | | | |
|---|---|---|---|
| 3,759,029 | 9/1973 | Komaki | 58/38 |
| 3,802,182 | 4/1974 | Fujita | 58/50 R |
| 4,051,664 | 10/1977 | Ishikawa | 58/50 R |
| 4,091,611 | 5/1978 | Fukuichi | 58/57.5 |

*Primary Examiner*—Vit W. Miska

*Attorney, Agent, or Firm*—Blum, Kaplan, Friedman, Silberman & Beran

[57] ABSTRACT

A solid state electronic timepiece including an intermittent supplemental functional capability, e.g., a lamp to illuminate the display, also includes a circuit for the prevention of an undesirable supply voltage drop due to circuit loading by the supplemental function during performance of a primary intermittent timekeeping function, e.g., shifting the contents of a shift register. The supplemental function is turned off during the primary intermittent timekeeping function. In an alternative embodiment, the initiation of the supplemental function is delayed to follow completion of the primary intermittent timekeeping function.

10 Claims, 2 Drawing Figures

SOLID STATE ELECTRONIC TIMEPIECE WITH LAMP

BACKGROUND OF THE INVENTION

Since the earliest stages of development of electronic timepieces, a ripple-down counting system using binary flip-flops has been used in the counter circuit. However, now many supplemental functions are required in addition to the basic primary function of keeping time. It is difficult to include many functions both primary and supplemental into an electronic timepiece using a conventional ripple-down dividing system. More recent circuits for electronic timepieces include the use of shift registers to supplement the basic divider system because many functions can be provided by using the shift register.

Many solid state electronic timepieces use liquid crystals with extremely small current consumption for their display. Because the liquid crystal is not self-illuminating, a lamp or an illuminating device is required in order to properly read the display in poorly-lit environments. However, because the resistance of the lamp is not large as compared with the internal resistance of the battery source, the supply voltage is appreciably lowered when lighting of the lamp is initiated. This condition is especially aggravated at low temperatures.

In a conventional ripple-down dividing system, because of its static operation, the contents of the system are not influenced by a drop in the supply voltage of a magnitude which would seriously affect the performance of a shift register. Where a shift register is used, there is a strong possibility of significant disordering of the contents of the register. Disturbance of performance due to a drop in the supply voltage may affect the dynamic operation of the shift register itself or that of the clock which controls the operation of the shift register.

What is needed is an electronic timepiece which combines supplemental functions, which load down the power supply source and diminish its voltage, on an non-interfering basis with primary functions requiring a high level of voltage for reliable performance.

SUMMARY OF THE INVENTION

Generally speaking, in accordance with this invention, an electronic timepiece especially suited for the inclusion of supplemental functions which load down the power supply and diminishes output voltage, is provided. More particularly, the onset of the supplemental function is not permitted to occur simultaneously with the onset of a primary function requiring a high level of voltage. A lamp to illuminate the display is a typical example of a supplemental function which loads down the battery of the electronic timepiece. A shift register is a good example of a primary function in the electronic timepiece which requires a high level of voltage for reliable performance. In an exemplary embodiment the circuits of this invention prohibit the lighting of the lamp at the time when the shift register is in dynamic operation and shifting. In an alternative embodiment, the lamp, if lit, is turned off during the shifting of the register. In another embodiment the dynamic operation is delayed until the supplemental function is completed.

Accordingly, it is an object of this invention to provide an improved electronic timepiece having the capability of performing supplemental functions on a basis which does not interfere with the operation of primary functions.

Another object of this invention is to provide an improved electronic timepiece which prevents the starting of a supplemental function during the occurrence of a primary function which requires a high level of voltage from the battery source during its performance.

A further object of this invention is to provide an electronic timepiece which interrupts the performance of a supplemental function upon the onset of the performance of a primary function which requires a high level of voltage for reliable performance.

Still another object of this invention is to provide an electronic timepiece which combines the advantages of a shift register with the advantages of an illuminating lamp for the display.

Yet another object of this invention is to provide an electronic timepiece which provides a lamp to illuminate the display and turns off the lamp during the performance of internal timekeeping functions which require a high level of supply voltage for reliable performance.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
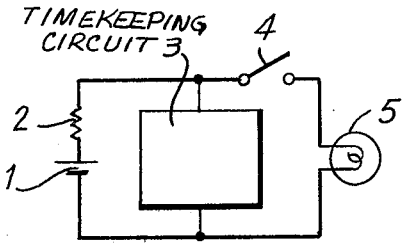
FIG. 1 is a semi-schematic diagram of the timepiece of this invention including a lamp as the supplemental function.

FIG. 1 schematically illustrates a timepiece including a timekeeping circuit 3 connected to a power supply comprising the voltage source 1 and an internal resistance 2. A lamp 5, of the incandescent filament type, is connected in parallel with the timekeeping circuit 3 and the power supply. This lamp 5 is a supplemental function and only operates when the switch 4 is closed on demand. In FIG. 1, the switch is shown as a single pole—single-throw switch, however in the embodiments described hereinafter the switch 4 is represented also by logic circuits and a transistor in series with the lamp 5 to serve as the switch. Nevertheless, the simple diagram of FIG. 1 illustrates the problem associated with the lamp 5 at the time that it is illuminated. In FIG.

2, the ordinate represents the voltage provided by the power supply including the voltage source 1 and the internal resistance 2. Time is represented on the abscissa. When the lamp 5 is not lit, nearly the no-load voltage $V_o$ of the power supply 1, 2 is applied to the timekeeping circuit 3 because the internal resistance of the timekeeping circuit 3 is large in comparison with the internal resistance 2 of the power supply. The lamp 5 has a small resistance value Rmi at the time when the lamp is not lit and the filament is cold. However, when the lamp is lit the resistance value increases in proportion to the rise in temperature of the filament and reaches a value Rma which is several times as great as the value Rmi. Thus, when the lamp switch 4 is closed at the time $t_o$, and the resistance of the lamp 5 is at a value Rmi, the voltage drops down to Vmi because of the large current which will flow in the lamp with its low resistance. The value of the voltage Vmi at the time $t_o$ when the lamp is first lit is calculated by the following equation, where r is the internal resistance 2:

$$Vmi = Rmi/(r+Rmi)\ V_o.$$

When the lamp has become heated and its resistance has risen to the value Rma, the current from the power supply is lower and the voltage of the source increases to the value Vma and is calculated by the following equation:

$$Vma = Rma/(r+Rma)V_o.$$

Figure 2:
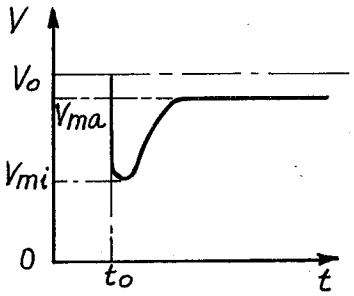
FIG. 2 is a voltage versus time chart showing the voltage characteristics at the onset of lighting the lamp of FIG. 1.

The voltage characteristic is aggravated when the temperature is low and the value of the internal battery resistance 2 is considerably increased. Then the values of Vmi and Vma are much lower than that of $V_o$, as shown in FIG. 2, which makes it difficult to obtain stable dynamic operations within the timepiece. Dynamic operations include such functions as the shifting of the contents of a shift register and in certain cases the use of dynamic dividing stages for use with time standards capable of operating in the mega-hertz range. Therefore, it is preferable that such dynamic operations as shifting of a register should not occur at the time of lighting of the lamp which corresponds to the time of the initial and most severe voltage drop. On contrast with this concept, the lamp 5 should not be lit at the time of dynamic operations within the timekeeping circuit 3. However, with the control circuits described hereinafter, the initial voltage drop to the value Vmi does not occur when the timekeeping circuit 3 performs a dynamic operation such as shifting of a shift register.

Figure 3:
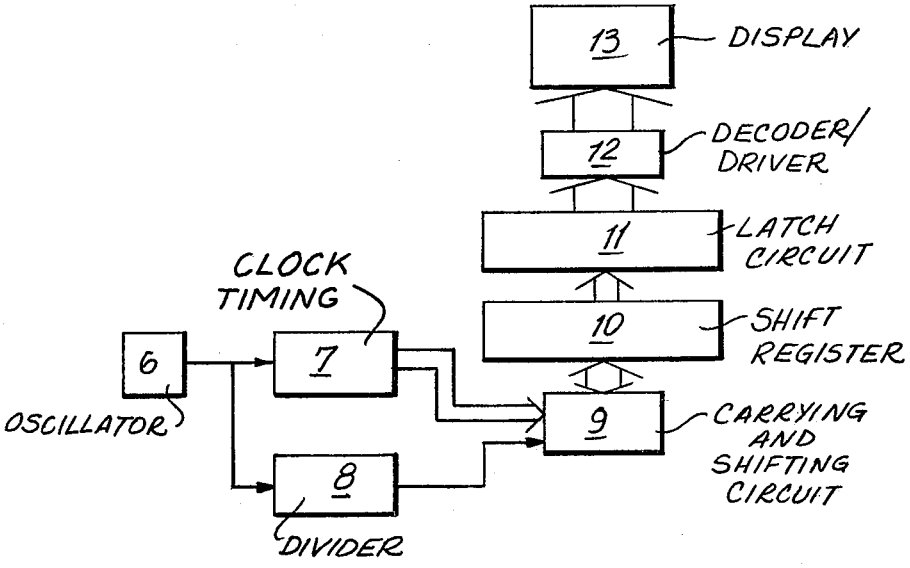
FIG. 3 is the block diagram of a timepiece using shift register circuitry.

FIG. 3 is the functional block diagram for a timepiece which can use the circuits of this invention. A high frequency time standard signal on the order of $2^{16}$ Hz, is outputted from the clock oscillating circuit 6 and is divided down to a 1 Hz signal by the divider circuit 8. The timing signal for shifting the shift register 10 is provided by the clock timing circuit 7. The carrying and shifting circuit 9 controls the carrying of hours, minutes, seconds etc. A latch circuit 11, a decoder-driver circuit 12 and a display 13 complete the timepiece of FIG. 3. This is a conventional timepiece which includes a shift register and thus serves as a good example to illustrate the circuits of this invention. Operation of the functional circuits of FIG. 3 is not a novel part of this invention and needs no detailed description herein. The timepiece of FIG. 3 can be considered as incorporated as the timekeeping circuit 3 in FIG. 1 for the purpose of illustrating the circuits of this invention.

The combination of the circuits of FIGS. 1 and 3 provides a timepiece having the primary functions of timekeeping, including a dynamic operation in shifting the contents of the shift register, and a supplemental function in providing a lamp to illuminate the display when the switch 4 is closed. As stated above, initiation of lighting of the lamp 5 causes the voltage output of the power supply 1, 2 to drop whereas the dynamic driving of the shift register 10 requires for stable reliable operation that the voltage from the supply be maintained above a prescribed level.

Figure 4:
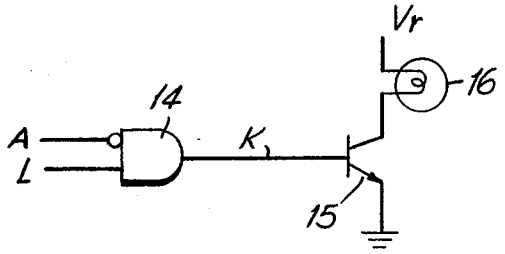
FIG. 4 is a switching circuit schematic for use in the timepiece of FIG. 1.

FIG. 4 is a circuit illustrating the principles of the instant invention. One end of the filament of a lamp 16 is connected to the collector of an NPN transistor 15 having a grounded emitter. The other end of the filament is connected to a voltage source $V_r$. An AND gate 14 has two inputs, namely, A and L. However, input A is a NOT input and hence the signal to the AND gate is inverted thereat. The output of AND gate 14 is connected to the base of the transistor 15.

Figure 5:
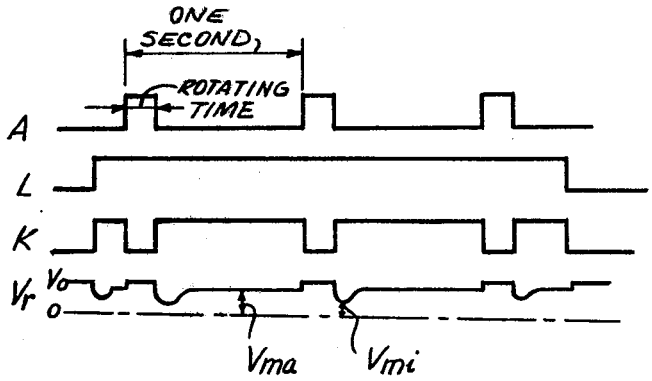
FIG. 5 illustrates the timing waveforms associated with the circuit of FIG. 4.

As seen in FIG. 5, the timekeeping circuits produce a signal A which includes a square wave pulse of finite width occurring at intervals of one second. The width of the pulse signal A is identified in FIG. 5 as 'rotating time' to indicate the time during which the contents of the shift register 10 are shifted. The signal L of FIG. 5 represents the time that lighting of the display is demanded. In an actual timepiece, lighting is initiated by manually closing the switch 4 by pressing a button on the side of the timepiece. As illustrated in FIG. 5, the lighting switch is closed for a period including several shifts of the contents of the shift register. The output K of the AND gate 14 goes high only when the A input to the AND gate 14 is low, and the input L to the AND gate 14 is high. When the output K is high, elevating the potential on the base of transistor 15, the transistor 15 conducts and the lamp 16 is lit. Thus it is not possible for the lamp 16 to be lit when the input signal A is high, that is it is not possible for the lamp to be lit during the period of time that the shift register is shifting its contents. Whenever the input L is high, indicating that the lighting switch is closed, and the input A is low, the lamp 16 is lit. If an attempt is made to initiate lighting at the instant when the shift register is being shifted by the pulse A, then the light will not come on until completion of the pulse A and the shifting of the shift register. It can further be seen in FIG. 5 that the voltage from the source is at its maximum value $V_o$ when the light is off; accordingly, at any time of shifting of the shift register there is full voltage $V_o$ available from the power supply $V_r$. On the other hand, the extreme drop in voltage to the value Vmi can only occur at a time independent of shifting of the register. Thus there is no conflict in the demands for power of these two functions. The supplemental function of illuminating the display by lighting the lamp 16 decreases the voltage from the source at a time when dynamic operation of the shift register is not required. Conversely, the shift register only shifts when full power is available. Reliable operation of both functions is assured by this circuit. To incorporate the circuit of FIG. 4 into the semi-schematic timepiece of FIG. 1, it is merely necessary to recognize that the ground in FIG. 4 connects to the negative terminal of the power source 1 in FIG. 1, and the lamp 16 of FIG. 4 corresponds to the lamp 5 of FIG. 1. The switch 4 in FIG. 1 on demand applies voltage $V_r$ to the circuit of FIG. 4 and produces the timing signal L by circuit means not shown on the drawings.

Figure 6:
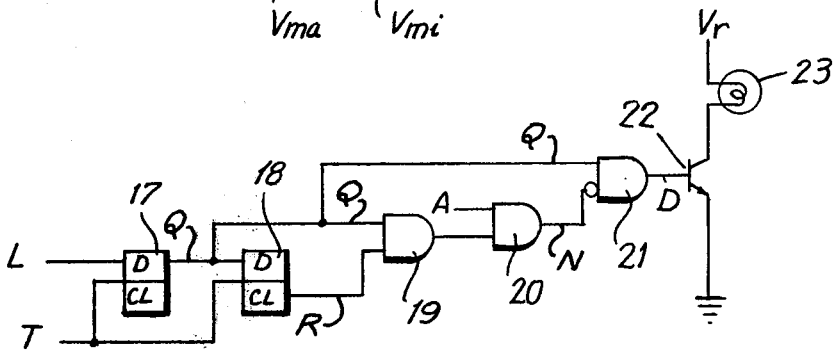
FIG. 6 is an alternative logic switching circuit for operation of the lamp of FIG. 1.

FIG. 6 illustrates an alternative embodiment of this invention. In this circuit the lamp 23 is connected in series with the transistor 22 between the voltage source $V_r$ and ground in a manner similar to that of FIG. 4 described above. The output D of AND gate 21 connects to the base of transistor 22 and causes transistor 22 to conduct when the output D is high. The output D is high only when the input N to gate 21 is low while simultaneously the input Q to circuit 21 is high. The Q output of D-type flip-flop circuit 17 is connected to the input of the D-type flip-flop circuit 18. The input to the flip-flop circuit 17 is high when the lamp switch is closed with the intent of initiating lighting of the display. Both flip-flop circuits 17, 18 are strobed by the timing signal T which is derived from the divider of the timepiece. It should be noted that the flip-flop 17 propagates to its output Q whatever information, high or low, is at its L input concurrently with the clock pulse. The flip-flop acts on the leading edge of a clock pulse. Thus it can be seen that the output R of flip-flop 18 will be the inverse of the output Q from flip-flop 17, however, the output R will not appear simultaneously with the output Q because of the delay which occurs in the flip-flop 17. As a result, the output R appears on the next positive-going pulse of the timing signal T. The outputs Q and R are inputted to the two inputs of AND gate 19 and the output of AND gate 19 provides one input to the AND gate 20. The other input A to the AND gate 20 is the timing pulses A of finite width during which time the dynamic operation of shifting the contents of the shift register is accomplished. The output N of AND gate 20 is one input to the AND gate 21. It is only when the input N to the AND gate 21 is low and the input Q resulting from a high at terminal L will the output D be positive and light the lamp 23.

Figure 7:
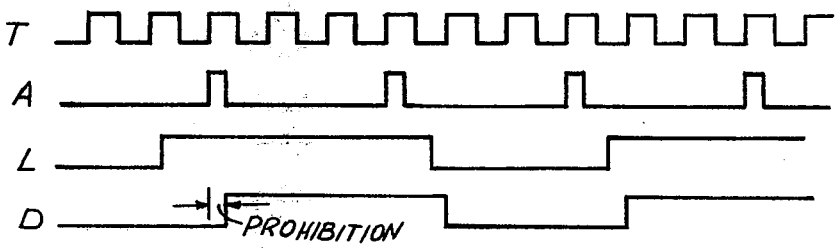
FIG. 7 illustrates the timing waveforms associated with the circuit of FIG. 6.

It can be seen from the waveforms of FIG. 7 that when an A pulse occurs when the lamp 23 is already lit, as indicated by a high condition of output D, there is no interruption in the output D so long as the input L caused by the closing of the light switch remains high. However, when a shift register pulse A occurs when the light is not lit as indicated by a low in the signal D inputted to the base of the transistor 22, then although the signal L is high with the intent of causing the lamp 23 to light, there is a delay in the illumination of the lamp 23 until the pulse A is completed. This is indicated in FIG. 7 as a prohibition. To summarize the operation of the circuit of FIG. 6: The input L from the lamp switch must be high if the lamp is to be lit at all. However, the lamp is only initially lit when no shift register pulse A exists at the time when the lamp would normally go on, that is, when the timing signal T goes high at its leading edge. Thus the lamp will not be lit when a shift operation in the shift register is occurring. The problems of low voltage caused by lighting of the lamp are avoided. After the lamp is lit and its filament has heated to a higher resistance, the voltage drop caused by the lamp is not so great. Thus it is unnecessary to turn the lamp off for shifting of the register which occurs when the lamp is already lit.

It should be recognized that in alternative embodiments of this invention functions other than lamp-lighting may be the cause of a drop in voltage. Similarly, the shift register may not be the dynamic operation which requires optimum power supply conditions during its period of performance. The principles of operation will remain the same. The supplemental function which lowers the battery voltage will not be permitted to initiate at a time when the dynamic operation is performed.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. In an electronic timepiece having in combination a plurality of primary functional means for timekeeping including a generator of standard timing signals, at least one of said primary functional means being a dynamically operating circuit, said dynamic operation circuit intermittently counting said timing signals, said at least one primary intermittent function being reliably performed when the voltage applied to said at least one primary intermittent function means is above a prescribed level;

a non-constant voltage power source supplying said at least one primary functional means and having a no-load voltage in excess of said prescribed level, the voltage output of said source diminishing as current drain from said source increases;

and means for performing an intermittently operated supplemental function, said source voltage diminishing at the start of said intermittent supplemental function, the improvement therein comprising:

means for permitting simultaneous performance of both said primary and said supplemental functions and prohibiting the start of performance of said supplemental intermittent function until the time period of at least one primary intermittent function is completed.

2. The electronic timepiece of claim 1, and further comprising a lamp, a display and circuit means for detecting the time period of counting said timing signals intermittently and for controlling said supplemental function, said supplemental function being the lighting of said lamp for illuminating said display.

3. The electronic timepiece of claim 2, wherein said dynamic operation circuit comprises a shift register, said shift register regularly counting the time by using the timing signal of a clock timing circuit in response to said timing standard signal, and controlling the lighting of said lamp for illumination.

4. The electronic timepiece of claim 1, and further comprising a lamp and wherein said dynamic operation circuit comprises a shift register, said shift register regularly counting the time by using said timing signals of said clock timing circuit in response to said timing standard signal, the signal to command the lighting of said lamp for illumination being applied to said clock timing circuit, said clock timing circuit being adapted to shift in time said signal to command the lighting of said lamp for illumination away from said timing signal.

5. In an electronic timepiece having in combination:

a plurality of primary functional means for timekeeping, one of said primary means performing an intermittent timekeeping function, said primary intermittent timekeeping function being most reliably performed when the voltage applied to said one primary intermittent function means is above a prescribed level;

a non-constant voltage power source supplying said one primary functional means and having a no-load voltage in excess of said prescribed level, the voltage output of said source diminishing as current drain from said source increases;

and means for performing an intermittently operated supplemental function, said source voltage diminishing at the start of said intermittent supplemental function, the improvement therein comprising:

means for prohibiting performance of said supplemental function during performance of said primary function, including a logic gate, the output signal of said logic gate feeding the base of a transistor, the emitter and collector of said transistor being in series with said supplemental function means and said power source, said logic gate output going high only when a select one input to said logic gate is low and when another input to said logic gate is high, whereby the inputs to said logic gate control said transistor base and the on-off operation of said supplemental function means, said select one input to said gate being high only during the time period when said one primary function is performed, and said other input being high only when said supplemental function is demanded for performance, whereby said primary function and said supplemental function are never performed concurrently and said primary function has priority.

6. The electronic timepiece of claim 5, wherein said supplemental function means is a lamp and the performed intermittent function is the output of light, and said one primary function means is a shift register and the performed intermittent function is shifting of the contents of said register by one stage.

7. The electronic timepiece of claim 4, wherein said transistor is an NPN transistor.

8. In an electronic timepiece having in combination:

a plurality of primary functional means for timekeeping, one of said primary means performing an intermittent function, said primary intermittent function being most reliably performed when the voltage applied to said one primary intermittent function means is above a prescribed level;

a non-constant voltage power source supplying said one primary functional means and having a no-load voltage in excess of said prescribed level, the voltage output of said source diminishing as current drain from said source increases;

and means for performing an intermittently operated supplemental function, said source voltage diminishing at the start of said intermittent supplemental function, the improvement therein comprising:

means for prohibiting initiation of said supplemental function during performance of said one primary function, including switch means connected intermediate said supplemental function means and said power source and having a control input, said switch means being adapted to selectively energize said secondary function means when a signal of a predetermined state is applied to said control input, and logic gate means having an output coupled to said switch means control input and first and second inputs, said logic gate means output applying said predetermined state signal to said switch means input only when said logic gate means first and second inputs are at predetermined states, whereby the inputs to said logic gate means control said switch means and the on-off operation of said supplemental function means, said logic gate means first input being in its predetermined state only when said supplemental function is demanded for performance, and said logic means second input being out of its predetermined state only when the onset of said one primary function occurs prior to the initiation of performance of said demanded supplemental function, whereby both functions are never initiated concurrently.

9. The electronic timepiece of claim 8, wherein said first input is the output of a first AND gate, one input to said first AND gate being high during the performance of said one primary function, the other input to said first AND gate being the output of a second AND gate, the first input to said second AND gate being the output of a first D-type flip-flop, the second input to said second AND gate being the output of a second D-type flip-flop, the output of said second flip-flop being the delayed and inverted output of said first flip-flop.

10. The electronic timepiece of claim 9, wherein both said flip-flops are clocked by the same timing signal, and said one primary function is performed in synchronism with said timing signal, whereby initiation of said supplemental function is delayed until said one primary function is complete.

* * * * *